US005489191A

United States Patent [19]

Tai

[11] Patent Number: 5,489,191

[45] Date of Patent: Feb. 6, 1996

[54] MOTOR COVER FOR CEILING FAN FOR MOUNTING FAN BLADES

[76] Inventor: Chun-Ya L. Tai, 9F-3, No. 92, Gin-Chang Rd., Taichung, Taiwan

[21] Appl. No.: 290,285

[22] Filed: Aug. 15, 1994

Related U.S. Application Data

[63] Continuation of Ser. No. 63,230, May 12, 1993, abandoned.

[51] Int. Cl.[6] ..... F04D 29/64

[52] U.S. Cl. ..... 416/5; 417/360; 417/423.14; 417/423.8

[58] Field of Search ..... 417/423.14, 423.15, 417/424.1, 424.2, 423.8, 360; 416/5

[56] References Cited

U.S. PATENT DOCUMENTS

D. 265,502 7/1982 Kearnes ..... 416/5
D. 270,563 9/1983 Phillips ..... 416/5
D. 285,720 9/1986 Markwardt ..... 416/5
4,511,310 4/1985 Pearce ..... 416/5
4,863,346 9/1989 Lin ..... 416/5

FOREIGN PATENT DOCUMENTS 0537832 4/1956 Italy ..... 417/423.8

*Primary Examiner*—Richard A. Bertsch
*Assistant Examiner*—William Wicker
*Attorney, Agent, or Firm*—Browdy and Neimark

[57] ABSTRACT

A motor cover for ceiling fan comprises a predetermined number of flange fixed holes which are arranged concentrically and spaced equidistantly for mounting thereto four or five fan blades so that all portions of the motor cover are similar in weight and centrifugal force to one another, and that the motor cover is stable and quiet when in operation.

8 Claims, 4 Drawing Sheets

MOTOR COVER FOR CEILING FAN FOR MOUNTING FAN BLADES

This application is a continuation of application Ser. No. 08/063,230, filed May 12, 1993 now abandoned.

FIELD OF THE INVENTION

The present invention relates to a ceiling fan rotor, and more particularly to a motor cover for a ceiling fan mounting fan blades which has a well-balanced center of gravity so as to rotate stably and to facilitate the installation of the fan blades.

BACKGROUND OF THE INVENTION

As shown in FIG. 1, a conventional ceiling fan motor cover 10 of the prior art is provided with a plurality of flange fixed through holes 12, which are arranged in a specific pattern that enables four or five fan blades to be mounted to the same ceiling fan in accordance with the preference of a consumer. In the process of installing the fan blades, each blade of the ceiling is mounted to the two through holes. If the fixed number of the fan blades is four, the fan blades are then mounted in a pattern designated as "A". If the fixed number of the fan blades is five, the fan blades are mounted in a pattern designated as "B", as shown in FIG. 1. Such structural design as described above has several shortcomings, which are elucidated hereinafter.

The weight of the motor cover 10 is not evenly distributed in view of the fact that the flange fixed through holes 12 are not evenly distributed, thereby causing various portions of the motor cover 10 to have different centrifugal forces at the time when the motor cover 10 is caused to rotate. As a result, the motor cover 10 tends to wobble and makes a lot of noise when in operation. Such a prior art motor cover 10 has a relatively short service life span.

The flange fixed through holes 12 of the motor cover 10 are so distributed that they often make the installation of the fan blades rather confusing and time-consuming. In other words, the installation of the first fan blade must be started from a specific flange fixed through hole 12 so that the rest of the fan blades are mounted sequentially in a correct pattern.

Another kind of the motor cover of the prior art is shown in FIG. 2, in which the motor cover 14 is provided with a plurality of flange fixed through holes 16, which are arranged in two groups on the two circles having different diameters. Each of the two groups is arranged in a predetermined pattern. If four fan blades are to be mounted to the motor cover 14, the fan blades are mounted respectively in the flange fixed through holes 16 forming a pattern designated as "A". On the other hand, if five fan blades are to be mounted, the fan blades are then mounted in the flange fixed through holes 16 forming another pattern designated as "B". The motor cover 14 of the prior art has the following shortcomings.

The flange fixed through holes 16 of the motor cover 14 are so unevenly distributed that the weight of the motor cover 14 is thus distributed unevenly. As a result, the motor cover 14 wobbles when in operation. It is also rather time-consuming for a worker to mount the fan blades.

The flange fixed through holes 16 are formed in two groups, which are distributed on the circles having different diameters. As a result, the mounted fan blades will have different lengths, thereby undermining the efficiency of the ceiling fan to generate a current of air for ventilating or cooling.

SUMMARY OF THE INVENTION

It is therefore the primary objective of the present invention to provide a ceiling fan motor cover which has a symmetrically distributed weight so as to ensure that it has a balanced center of gravity, and that it does not wobble when in operation, and further that it is rather quiet when in operation, and still further that it has a long service life span.

It is another objective of the present invention to provide a ceiling fan motor cover which is so structurally designed that it facilitates the process of mounting thereto the fan blades.

It is still another objective of the present invention to provide a ceiling fan motor cover which is so structurally designed that it permits all four fan blades or all five fan blades to be mounted in such a manner that they all have the same length so as to enhance the efficiency of the ceiling fan to set up a current of air for ventilating or cooling.

The foregoing objectives of the present invention are attained by an improved motor cover on a ceiling fan, which comprises a total of twenty flange fixed through holes that are equidistantly arranged. As a result, all portions of the motor cover are similar in weight and centrifugal force. The rotor of the present invention does not wobble and is relatively quiet when in operation.

DETAILED DESCRIPTION OF THE INVENTION

Figure 1:
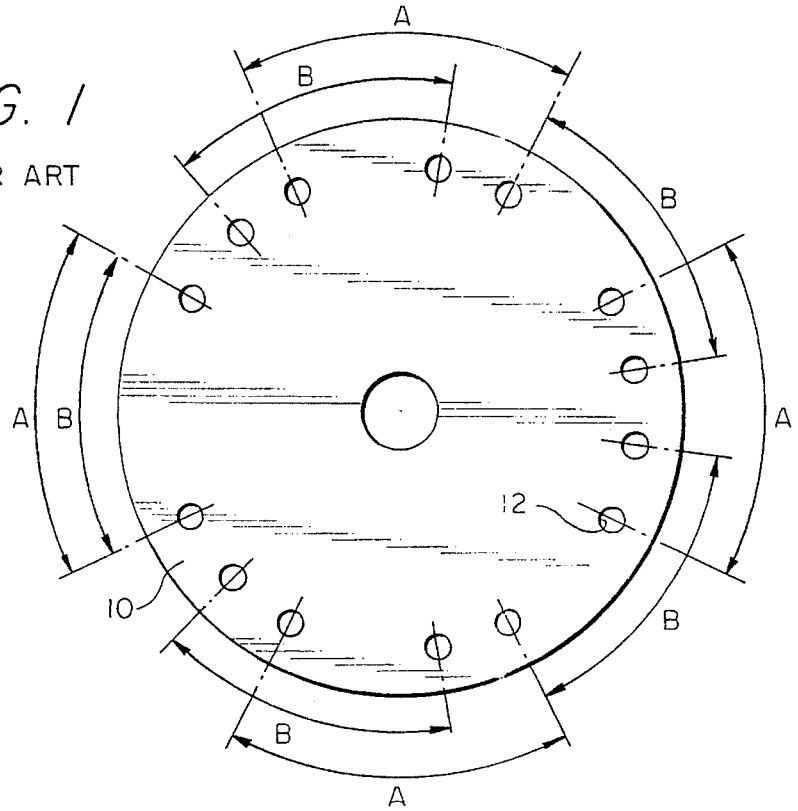
FIG. 1 PRIOR ART
FIG. 1 shows a schematic plan view of a motor cover of the prior art.
Figure 2:
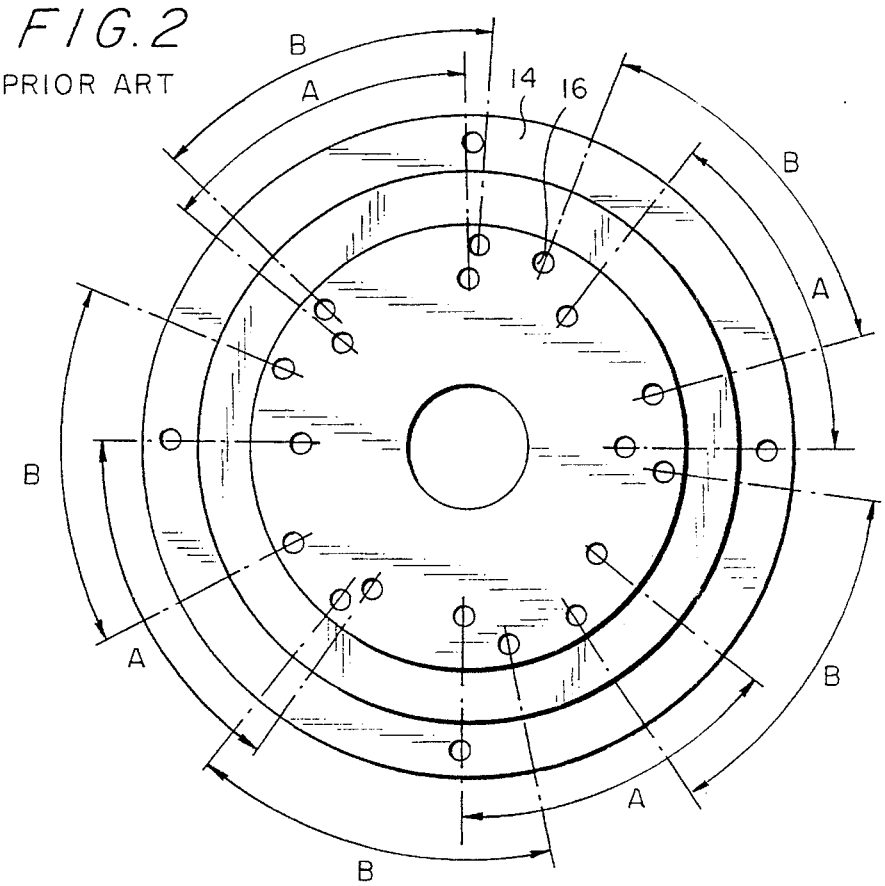
FIG. 2 PRIOR ART
FIG. 2 shows a schematic plan view of another motor cover of the prior art.
Figure 3:
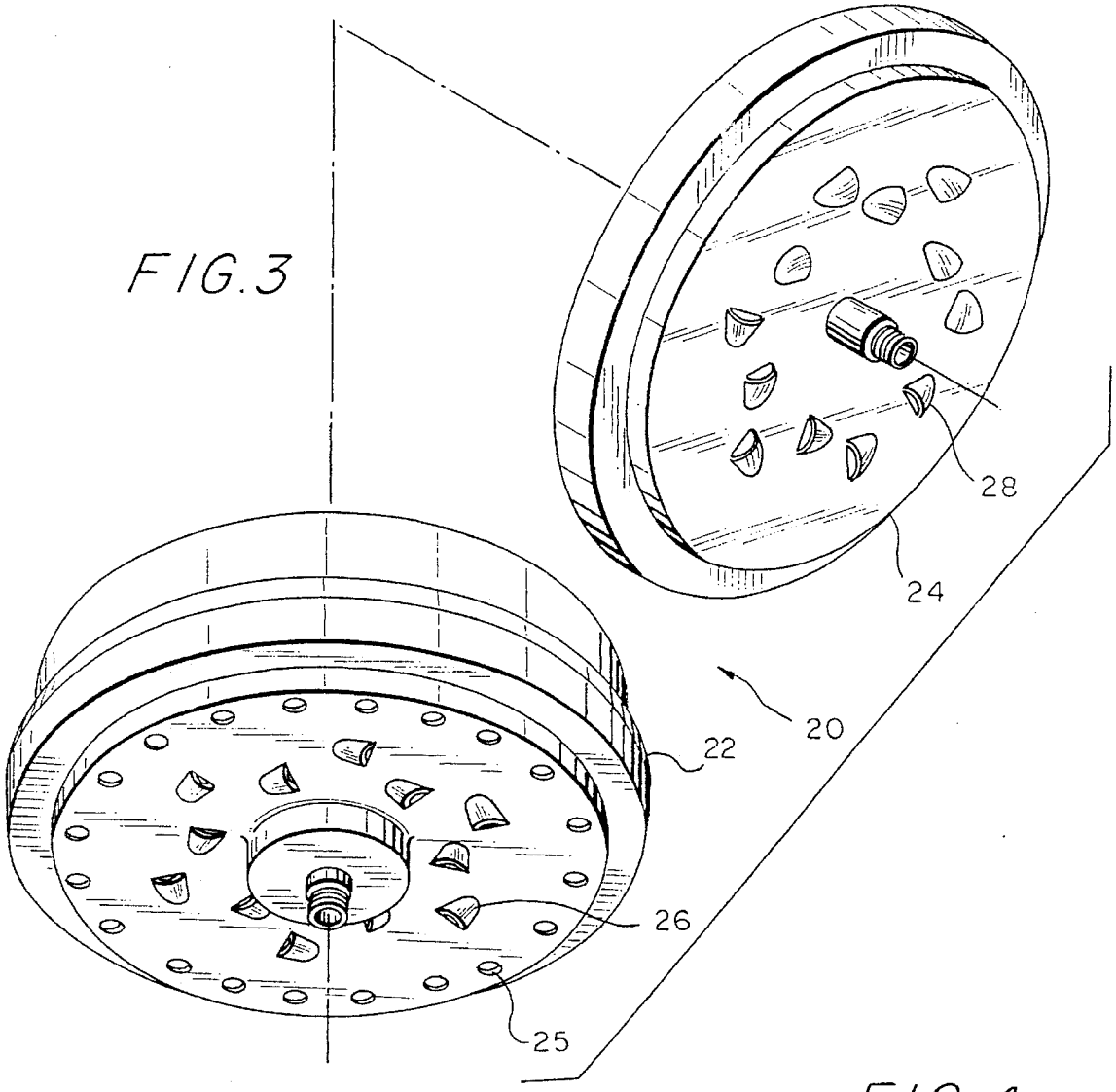
FIG. 3 shows an exploded view of a first preferred embodiment of the present invention.
Figure 4:
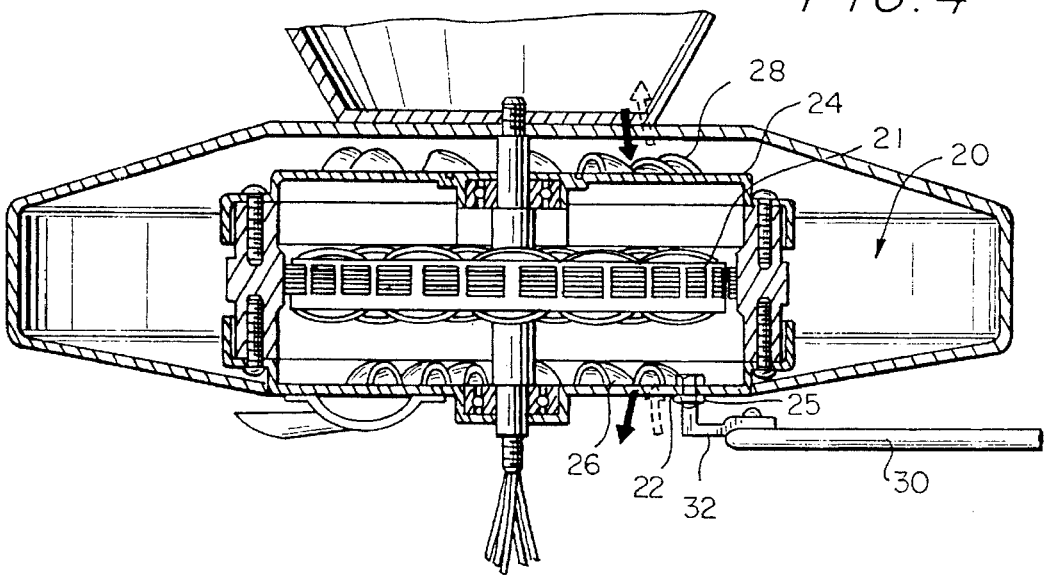
FIG. 4 shows a schematic view of the first preferred embodiment in action, according to the present invention.

Referring to FIG. 3, a motor cover 20 of the first preferred embodiment of the present invention is shown to comprise a lower portion 22 and an upper portion 24. Sandwiched between the lower portion 22 and the upper portion 24 is a driving device or motor stator 21, as shown in FIG. 4, for causing the motor cover 20 to rotate. The lower portion 22 is provided along the edge thereof with twenty flange fixed through holes 25 which are equidistantly arranged. Located in the inner area of the lower portion 22 are two rows of wind outlet holes 26 which are arranged concentrically and circularly. The upper portion 24 is provided along the outer area thereof with two rows of wind outlet holes 28 which are arranged concentrically and circularly. The wind outlet and wind inlet holes 26 and 28 are arranged in an alternating manner.

Figure 5:
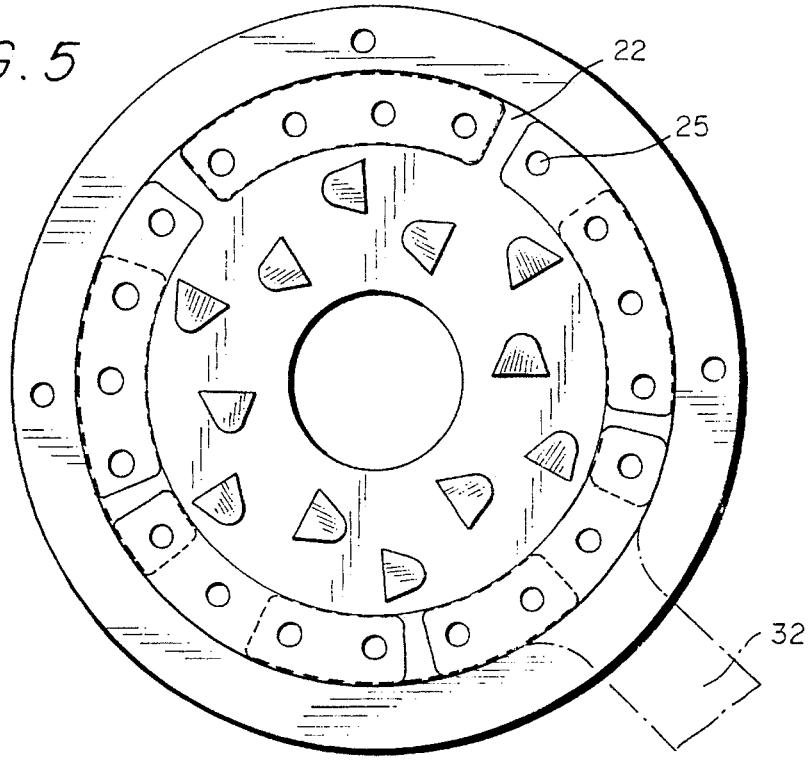
FIG. 5 is a schematic view showing that the fan blades are mounted on the motor cover as shown in FIG. 3.

As shown in FIG. 4, the motor cover 20 is mounted in the housing of a ceiling fan. A fan blade 30 is fastened to the motor cover 20 by means of a fastener which is received in the flange fixed hole 25 of the lower portion 22 and a connection hole 34 of a flange 32 of the fan blade 30. The pattern of mounting the fan blades is illustrated in FIG. 5. If four fan blades are mounted on the motor cover 20, the two flange 32 of the two adjacent fan blades are separated by one flange fixed hole 25, as shown by the dotted line. If five fan blades are mounted on the motor cover 20, the two flanges 32 of the two adjacent fan blades are adjacent to each other without being separated by one flange fixed hole 25, as shown by the solid line.

As soon as the motor cover 20 is driven to rotate, the fan blade 30 is actuated to generate a current of air. A clockwise rotation of the motor cover 20 causes the air to enter the motor cover via the wind inlet hole 28 of the upper portion 24. The air is then let out via the air guide hole 26 of the lower portion 22, as shown by the solid arrows in FIG. 4. A counterclockwise rotation of the motor cover 20 causes the air to enter the motor cover 20 via the wind inlet hole 26 of the lower portion 22. The air is then let out via the air guide hole of the upper portion 24, as shown by the dotted arrows in FIG. 4. The motor cover 20 is effectively cooled by the air current which carries away the heat generated by the motor cover 21. In addition, the entry of the air current into the motor cover 20 and the exit of the air current from the motor cover 20 are not affected adversely in any way by the wind inlet and wind outlet holes 26 and 28 which are arranged alternately.

Figure 6:
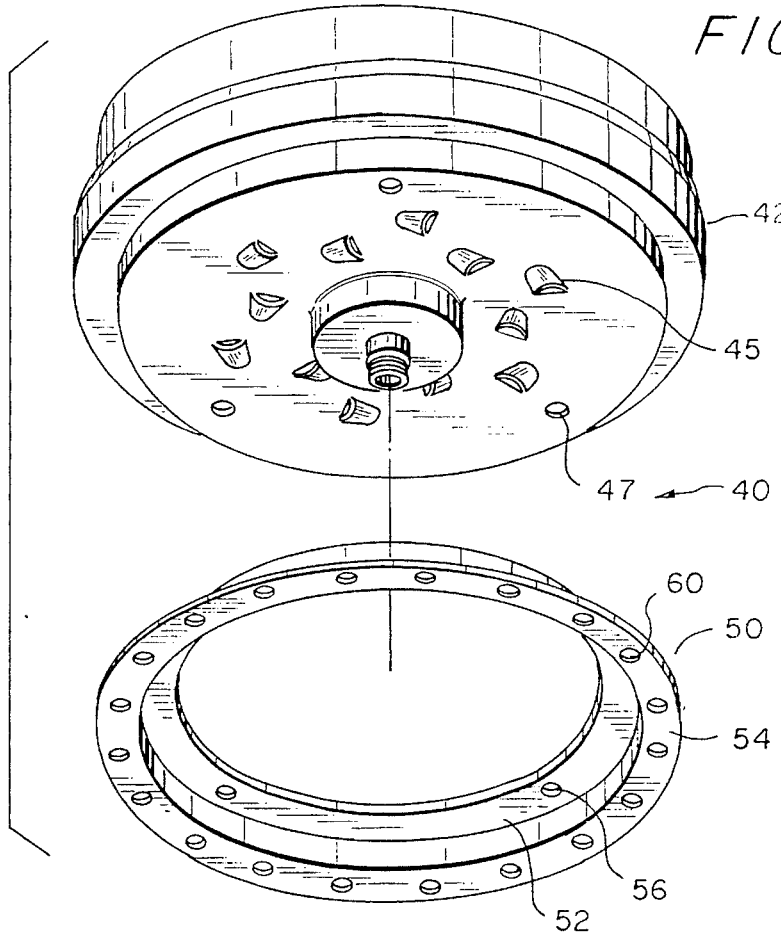
FIG. 6 shows a schematic view of a second preferred embodiment of the present invention.

The second preferred embodiment of the present invention is shown in FIG. 6, in which the motor cover 40 is shown to comprise a lower portion 42 provided with a plurality of wind outlet holes 45. The motor cover 40 further comprises or flange plate 50, which has an inner portion 52 of annular construction and an outer portion 54 of annular construction and connecting with the inner portion 52 which is provided with three equidistantly spaced flange plate fixed holes 60, which are arranged concentrically and spaced equidistantly.

In combination, the or flange plate 50 is fastened to the lower portion 42 of the motor cover 40 by means of fasteners which are received securely in the flange plate fixed holes 47 of the lower portion 44 and the pivoting holes 56 of the pivoting portion 52. As a result, the flange plate 50 can be driven by the motor cover 40 to rotate synchronously. The fan blades are mounted in the flange fixed holes 60 of the flange plate 50.

Figure 7:
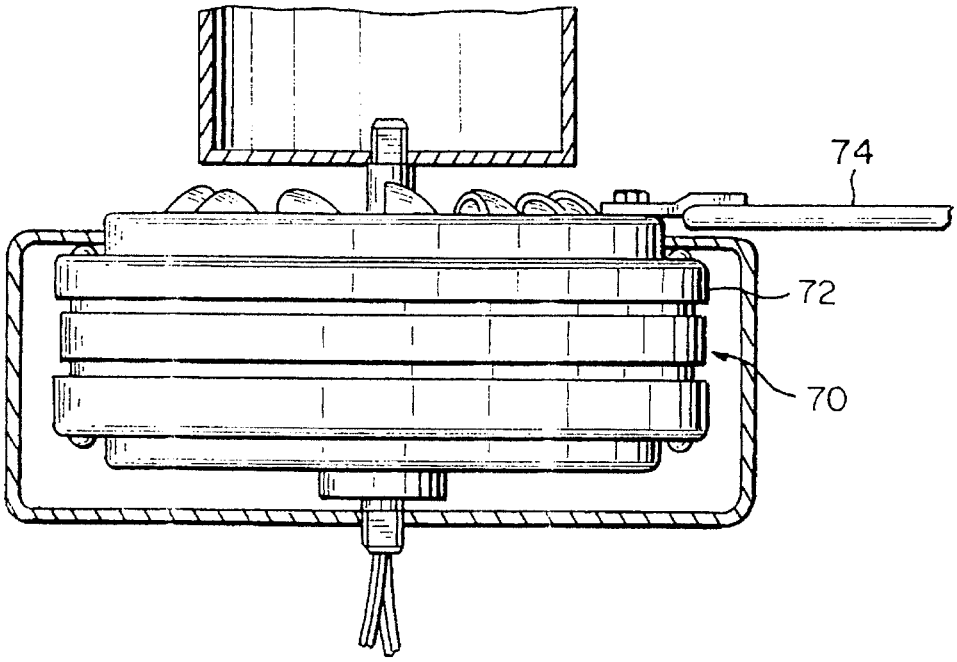
FIG. 7 shows a schematic view of a third preferred embodiment of the present invention.

The third preferred embodiment of the present invention is illustrated in FIG. 7, in which a fan blade 74 is shown to be mounted in the through holes, which are disposed in an upper portion 72 of a motor cover 70.

Figure 8:
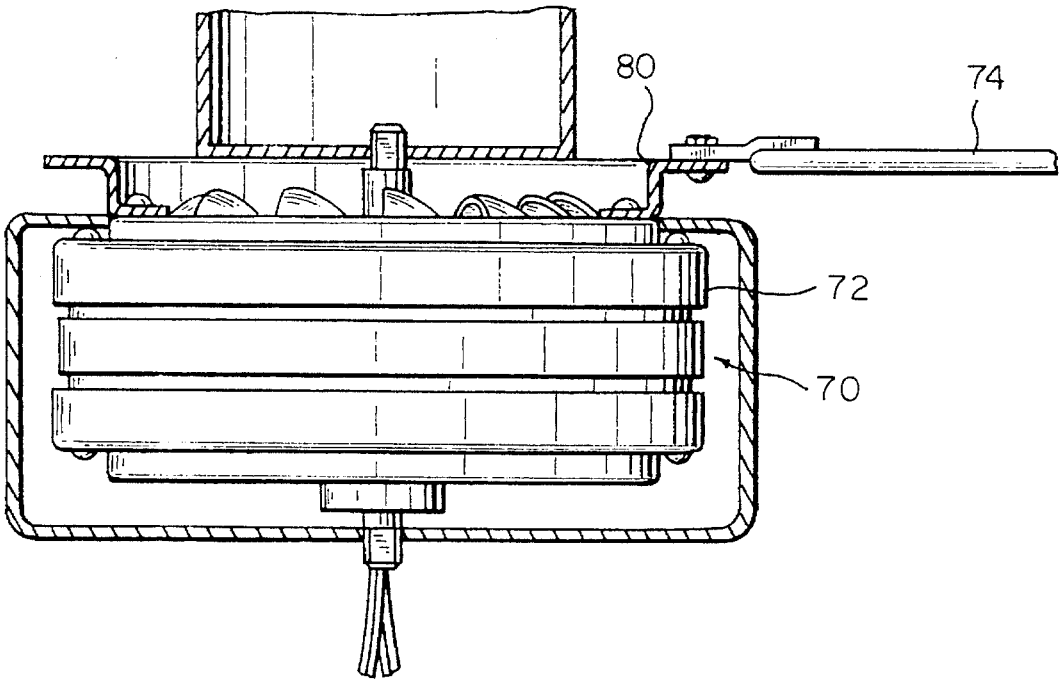
FIG. 8 shows a schematic view of a fourth preferred embodiment of the present invention.

As shown in FIG. 8, the fourth preferred embodiment of the present invention has a flange plate 80 which is fastened to the pivoting holes (not shown in the drawing) of the upper portion and is different from the third preferred embodiment in that the former has a flange plate 80 which is fastened to the pivoting holes (not shown in the drawing) of the upper portion 72 of the rotor 70, and that the fan blades are fastened to the flange plate 80.

The motor cover of ceiling fan motor cover of the present invention has advantages over the ceiling fan rotor of the prior art. Such advantages are further described explicitly hereinafter.

The ceiling fan motor cover of the present invention does not wobble and is quiet when in operation, in view of the fact that the flange fixed holes of the motor cover are spaced equidistantly and that all portions of the motor cover are similar in weight and centrifugal force. As a result, the motor cover of the present invention is relatively durable.

It is relatively easy for a worker to mount four or five fan blades on the motor cover of the present invention. If four fan blades are to be mounted on the motor cover, the mounting may begin with any one of the flange fixed holes of the motor cover. Two fan blades adjacent to each other are separated by one flange fixed hole. In case five fan blades are to be mounted on the motor cover, the mounting may begin with any one of the flange fixed holes of the motor cover. However, all fan blades so mounted are not separated by the flange fixed hole.

The wind inlet and wind outlet holes of the motor cover of the present invention are so alternately arranged that they do not interfere with one another with the entry of the air into the rotor and the exit of the air from the motor cover. As a result, the motor cover of the present invention is effectively cooled when in operation.

The motor cover of the present invention permits the fan blades, whether four blades or five blades, to be mounted thereon in such a manner that all mounted fan blades have the same length so as to enhance the efficiency of the ceiling fan to generate a current of air for cooling or ventilating.

The rotor of the present invention fits all types of ceiling fans.

What is claimed is:

1. A motor cover for a ceiling fan, which motor cover is configured such that the motor cover can without structural modification symmetrically support both a group of four blades and a group of five blades, said motor cover provided with twenty flange fixed holes located equidistantly from each other for use in mounting rotor fan blades to said ceiling fan; wherein said fixed flange holes are so arranged in a circle concentric to the shape of the motor cover that when four fan blades are mounted, the motor cover is balanced and when five blades are mounted, the motor cover is balanced.

2. A motor cover according to claim 1 having four fan blades mounted on said motor cover by means of flanges, whereby flanges of two adjacent fan blades are separated by one flange fixed hole.

3. A motor cover according to claim 1 having five fan blades mounted on said motor cover by means of flanges, whereby flanges of two adjacent fan blades are adjacent to each other.

4. A motor cover for a ceiling fan, which motor cover is configured such that the motor cover can without structural modification symmetrically support both a group of four blades and a group of five blades, said motor cover provided with twenty flange fixed holes located equidistantly from each other for use in mounting rotor fan blades to said ceiling fan; wherein said flange fixed holes are so arranged in a circle concentric to the shape of the motor cover that when four fan blades are mounted, the motor cover is balanced, and when five blades are mounted, the motor cover is balanced;

wherein when four fan blades are mounted on said motor cover by means of connection mounts, connection mounts of two adjacent fan blades are separated by one flange fixed hole; and when five fan blades are mounted on said motor cover by means of connection mounts, connection mounts of two adjacent fan blades are adjacent to each other.

5. The motor cover according to claim 4 wherein said flange fixed holes are all disposed in one side surface of said motor cover.

6. The motor cover according to claim 4 wherein said motor cover has an upper surface and a lower surface, said upper surface and said lower surface being provided with a predetermined number of wind inlet holes and wind outlet holes which are arranged alternately into two groups concentric about an axis of rotation so as not to interfere with the entry of air into the motor cover or exit of air from the motor cover.

7. The motor cover according to claim 4 further comprising an annular body mounted on one side surface thereof such that said annular body is driven by said motor cover to rotate synchronously and that said annular body is provided with said flange fixed holes to which said fan blades of said ceiling fan are mounted.

8. The motor cover according to claim 7 wherein said annular body comprises an inner portion of a annular construction and an outer portion of annular construction an connecting with said inner portion, said annular body being fastened to said motor cover by said inner portion; and wherein said flange fixed holes are disposed in said outer portion of said annular body.

* * * * *